United States Patent [19]

Lindenmeier et al.

[11] Patent Number: 5,049,892

[45] Date of Patent: Sep. 17, 1991

[54] PANE ANTENNA SYSTEM HAVING FOUR TERMINAL NETWORKS

[75] Inventors: Heinz Lindenmeier, Planegg; Gerhard Flachenecker, deceased, late of Ottobrunn, both of Fed. Rep. of Germany, by Hildegard Flachenecker, heiress

[73] Assignee: Hans Kolbe & Co. Nachrichtenübertragungstechnik, Bad Salzdetfurth, Fed. Rep. of Germany

[21] Appl. No.: 505,975

[22] Filed: Apr. 6, 1990

[30] Foreign Application Priority Data

Apr. 6, 1989 [DE] Fed. Rep. of Germany ..... 3911178

[51] Int. Cl.[5] ..... H01Q 1/320; H01Q 21/000

[52] U.S. Cl. ..... 343/713; 343/701; 343/853; 343/862

[58] Field of Search ..... 343/711–713, 343/826, 850, 853, 860, 862, 873, 879, 908, 907, 701

[56] References Cited

U.S. PATENT DOCUMENTS

| | | | |
|---|---|---|---|
| 3,866,232 | 2/1975 | Weigt | 343/713 |
| 4,727,377 | 2/1988 | Yostuya et al. | 343/711 |
| 4,746,925 | 5/1988 | Toriyama | 343/713 |
| 4,864,316 | 9/1989 | Kaoru et al. | 343/713 |

FOREIGN PATENT DOCUMENTS

| | | | |
|---|---|---|---|
| 2106647 | 8/1971 | Fed. Rep. of Germany | 343/713 |
| 2429628 | 8/1976 | Fed. Rep. of Germany | 343/713 |
| 0222302 | 10/1986 | Japan . | |

*Primary Examiner*—Michael C. Wimer
*Assistant Examiner*—Peter Toby Brown
*Attorney, Agent, or Firm*—Michael J. Striker

[57] ABSTRACT

The pane antenna system has a plurality of antennas arranged on a non-conductive sheet installed in a metal body of a motor vehicle. Each antenna includes antenna conductors secured on the non-conductive sheet and connected to an input terminal of an assigned four-terminal network. The four-terminal networks are located on or in the proximity of the non-conductive sheet in the metal vehicle body. The other input terminal of respective networks is directly connected with an output terminal of the network. The other output terminal is connected via a high-frequency output line to a collecting or interconnecting region for output signals of all four-terminal networks. From the interconnection region all signals are fed via a single cable strand to a receiver. The cable strand includes a plurality of transmission lines, preferably in the form of coaxial cables, and defines an initial portion bridging the interconnection region on the non-conductive sheet and a ground point on the metal vehicle body.

23 Claims, 10 Drawing Sheets

18b
18a
15
14
11
8b
9b
22
21
10
8a
5a
9a
6a
7a
4a
12
2
5b
7b
4b, 6b
3b
3a
28
1

2
18
14
15
34
34
10a,d
1
8a,8d
3a
6a,4a
5a
6d
9a,d
7a,d
4d
3d
35
26
27
34
34
10b
9b
8b
4b,6b
5b
7b
3b
35
3c
7c
4c,6c
5c
9c
8c
10c

PANE ANTENNA SYSTEM HAVING FOUR TERMINAL NETWORKS

BACKGROUND OF THE INVENTION

The present invention relates to an antenna system which includes at least two antennas for frequencies up to an ultrahigh frequency range. The antennas are arranged on a non-conductive sheet such as a window pane framed in a metal body of a motor vehicle. Each antenna has at least one antenna conductor secured on the non-conductive sheet, a connection point on the antenna conductor, and a four-terminal network having two input and two output terminals.

Antenna systems of this kind are known, for example from the German application P 37 19 692.8. Such known multiple antenna arrangements on a single window pane of a motor vehicle provide a cost effective antenna diversity system for the ultrahigh frequency range or for the television frequency range, for example. The antenna diversity systems of this type require at least two antennas and provide a distinct improvement in the reception.

From the point of view of installation into a motor vehicle, such antenna systems are preferably designed so as to permit their integration into the body of a motor vehicle. This requirement is best met by so-called window pane antennas. Preferably, either the windshield pane or the rear window pane of a motor vehicle, due to their relatively large area are used for this purpose.

Prior art antenna arrangements, for example, in FIG. 1 of the German publication P 37 19 692.8, when used in connection with motor vehicles, have the special disadvantage that they require wire bridges or conductor bridges between a connection point on a conductor on the window pane and networks mounted on the body of a motor vehicle. Each of the networks extending on the vehicle body requires an attachment point on the electrically conductive body of the vehicle which frequently is identical with the present grounding point for high frequencies. From the point of view of a manufacturer of motor vehicles, this known arrangement of antennas has the considerable disadvantage of requiring a large number of conductor bridges from the pane to the vehicle body and a large number of individual components which in the course of production of the vehicle must be installed and connected. The assembly of the requisite grounding and, evidently, of the requisite mounting points in practice is also difficult for the vehicle manufacturer inasmuch as grounding and attachment points among other requirements, have to be readily accessible during the installation process and also for a possible exchange of defective components and, at the same time, they must be covered by screens under which the aforementioned extended networks take place.

Moreover, since the extended networks are distributed around the window pane of the motor vehicle, a complicated cable network for the antenna arrangement is a further disadvantage, because the output signals from the respective extended networks must be fed via a separate line to a diversity processor. With the increasing number of separate components needed for the antenna system, the cost of maintenance and storage of such component parts also increases, thus contributing to the disadvantages of prior art solutions.

SUMMARY OF THE INVENTION

It is therefore an objective of this invention to distinctly reduce the number of conductor bridges between the window pane and the metal body of the motor vehicle as well as the number of separate component parts of the antenna system to be individually mounted on and connected to the body of the vehicle.

In keeping with this object and others which will become apparent hereafter, one feature of this invention resides in the provision of a pane antenna system of the above described kind, in which each of the four-terminal networks is mounted on the window pane close to the vehicle body and each of the connection points of the respective antenna conductors being connected to one input terminal of the assigned four terminal network via a short conductor whose reactance for the effective frequency range is negligible. The other input terminal of the respective four-terminal network is connected to one output terminal thereof. A high-frequency output line is mounted on the window pane and is connected at one end thereof to the output terminals of one of the four-terminal networks and extends to an interconnection region located in proximity to the metal body of the motor vehicle. A ground point is provided on the metal body. A single strand of at least two transmission lines extends on the metal body and has an initial strand portion extending into the interconnection region, and the interconnection region includes conductors for connecting the output terminals of the other four-terminal networks and the other end of the output line to the respective transmission lines of the strand.

Advantages achieved by this invention in comparison with prior art antenna systems of this kind reside particularly in the reduction of the requisite number of electrical connections between the window pane and the vehicle body, and in the fact that individual mounting and interconnection of a large number of separate components, in practice mostly of amplifiers for active antennas, can be eliminated.

Such advantages of the invention result from the fact that all components of the system are directly mounted in, on or in the vicinity of the window pane of the motor vehicle and that all antenna signals and supply voltages are fed through a single strand of transmission cables.

The advantages of the invention increase with the number of individual antennas in the system inasmuch as the technological expenses are significantly below the manufacturing and installation expenditures of comparable prior art complex antenna systems of this type, where, in practice, four or more individual antennas must be designed as active antennas in order to eliminate mutual coupling phenomena.

The required component parts for the antennas of this invention can be applied to or mounted on a window pane in a fully automatic manufacturing process so that a complete antenna pane results, which, from the point of a view of a manufacturer of a motor vehicle, represents a single component part which can be inserted as a complete single unit in the body of a motor vehicle and interconnected with the rest of the receiving circuits via a single multiple connection member in the form of a strand of cables.

The novel features which are considered as characteristic for the invention are set forth in particular in the appended claims. The invention itself, however, both as to its construction and its method of operation, together with additional objects and advantages thereof, will be best understood from the following description of specific embodiments, when read in connection with the accompanying drawings.

DESCRIPTION OF THE PREFERRED EMBODIMENTS

Figure 1:
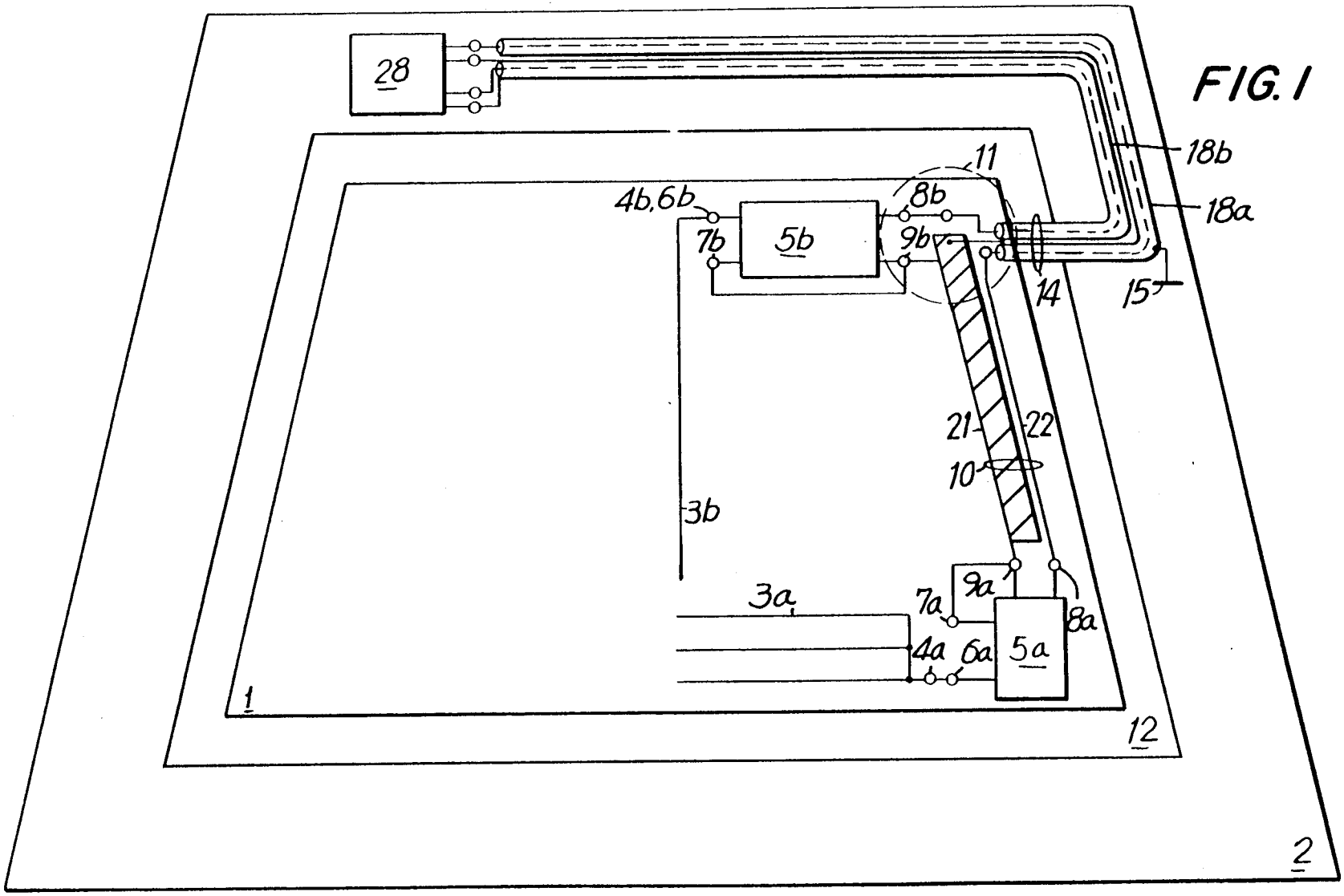
FIG. 1 show is a plan view of a pane antenna system for a motor vehicle, including two antennas with associated four terminal networks and output lines interconnected in a concentrated region with a single strand of two transmission cables.

FIG. 1 illustrates one exemplary embodiment of the pane antenna system of this invention having two antennas. The non-conductive sheet is formed by a window pane 1 and a plastic frame 12 also surrounding all sides of the pane. The metal body 2 of a motor vehicle surrounds the plastic frame and constitutes a grounding attachment for the antenna system. The non-conductive sheet or pane 1 within plastic frame 12 in contemporary motor vehicles can be for example, in the rear trap door of a station wagon. The trap or lift door of such motor vehicles can be connected to the conductive body of the motor vehicle by non-illustrated hinges.

The configuration of the pane antenna system illustrated in FIG. 1, which has a good efficiency, in the ultrashort wavelength range, cannot be attained by means of conventional antennas, in which for each of the four-terminal networks 5, a separate short connection to the grounding point on the conductive body of the vehicle is absolutely necessary. The permissible length of such grounding connections for the prior art antennas will be explained in more detail below. In this example, there is no possibility of providing a requisite short connection between the four-terminal network 5*a* in FIG. 1 and the grounding vehicle body, because in the case of rear trap doors, which are hinged to the vehicle body along their upper edge, such a grounding connection of the network 5*a* to the neighboring parts on the vehicle body 2 would be interrupted during the upward lifting of the rear door during its opening.

A characteristic feature of the pane antenna system of this invention is the presence of at least one high-frequency output line 10 applied on the non-conducting sheet, as a rule on a window pane 1, of the motor vehicle to provide the frequency connection between the output terminals of a four-terminal network and a collecting or interconnection region 11 for the output terminals of the other four-terminal network.

In the example of FIG. 1, the collecting or interconnection region 11 for the output signals of the two four-terminal networks 5*a* and 5*b* is located in one of the upper corners of the window pane. The four-terminal network 5*b* is situated in close proximity to the interconnection region so that its output terminals 8*b* and 9*b* project into the interconnection region 11. The other four-terminal network 5*a*, in contrast, is located in an opposite lower corner of the pane.

Its output terminals 8*a* and 9*b* are connected, respectively, to assigned ends of printed conductors 21 and 22 of the high-frequency output line 10. Conductors 21 and 22 extend in close proximity to each other and together form a waveguide for high-frequency signals.

Such a novel waveguide for use as a high-frequency output line 10 can consist, of a conventional coaxial cable or a twin wire cable, which is either glued on the pane or embedded between two layers of a laminated pane. Especially in the case of a coaxial cable, it is also possible, after removal of the cable insulation, to solder the outer sheath of the cable to a flat conductor printed on the pane, thus mechanically fixing the cable. However, such possibility necessitates additional operational steps during the production. Thus, expensive solutions for producing the high frequency output lines 10 can be achieved, for example, by conductors printed on the window pane as shown in FIG. 1. If the conductor 21 is distinctly broader than the other conductor 22, then the resulting waveguide is asymmetric and simulates a coaxial cable; i.e., it is a pseudo-coaxial cable. The broad conductor 21 in the following description will be called a pseudo-outer conductor, and the narrow conductor 22, a pseudo-inner conductor. In order to avoid conductor bridges to vehicle body 2, the high-frequency output line 10 is therefore arranged on the non-conducting surface. Such high-frequency output lines 10 as well as the antenna conductors 3*a* and 3*b* can be realized with a technological advantage and at low costs by the application of a conventional printing process on the window pane, for example, by means of screen printing. Frequently, the window panes for a motor vehicle are being printed on for other reasons, for example, to provide fields of heating elements in the pane of a rear trap door of a vehicle. In this case, there is no need for an additional working step for printing the antenna conductors and the high-frequency output lines.

Typical embodiments of printed high-frequency output lines 10 are shown in FIGS. 3 to 5, 7 and 8.

Figures 3, 4A, 4B, 5, 6A, 6B, 7, 8:
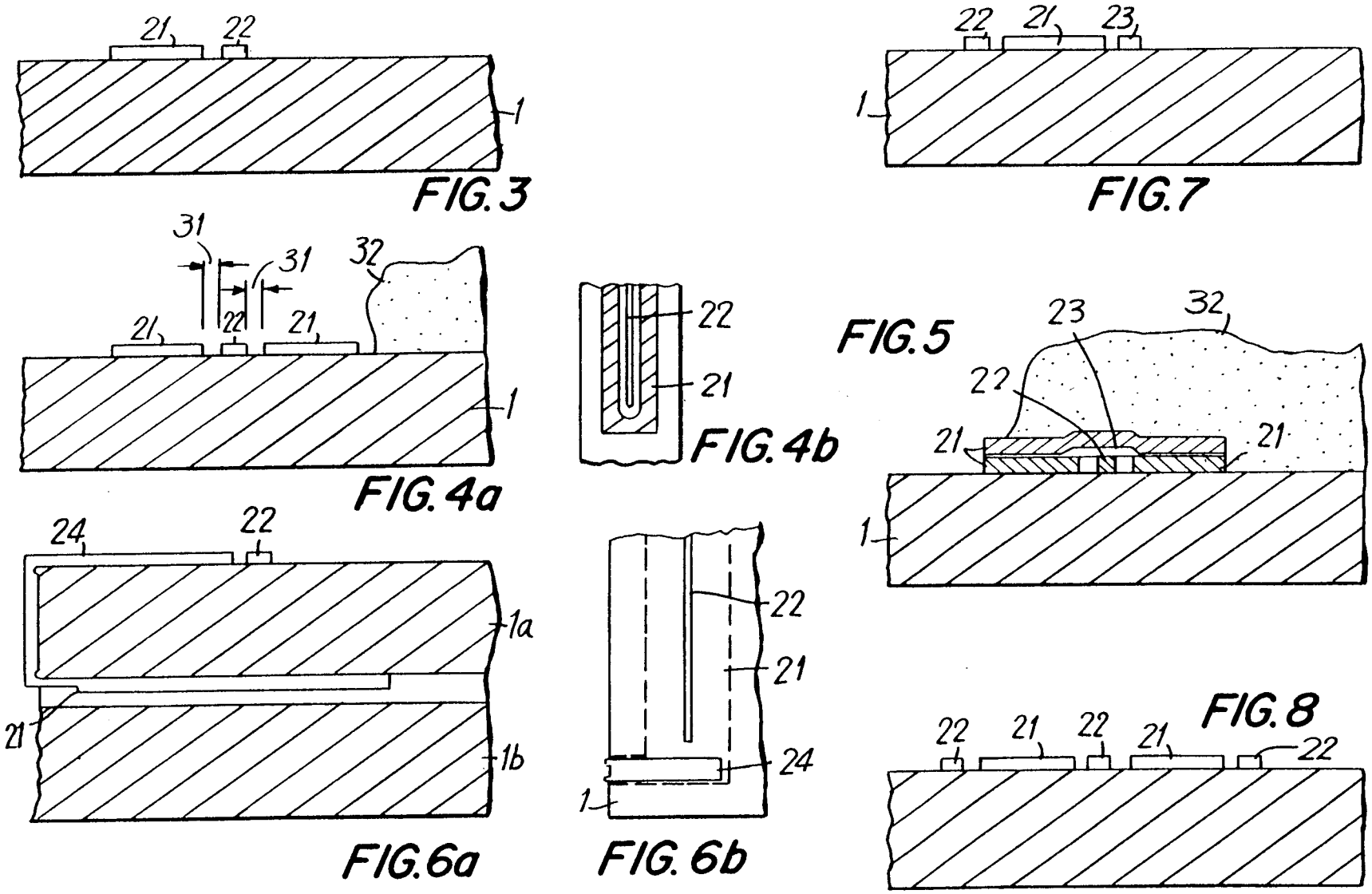
FIG. 3 show is a sectional side view of a printed-on, asymmetric high-frequency output line in the pane antenna system of the invention.
FIGS. 4*a* and 4*b* show another embodiment of the printed-on, asymmetric high-frequency output line in a sectional side view and a plan view respectively.
FIG. 5 shows a further embodiment of a printed-on, asymmetric high-frequency output line in a pane antenna system of the invention.
FIGS. 6*a* and 6*b* show in a sectional side view and a plan view respectively of still another embodiment of a printed-on, asymmetric high-frequency output line partially embedded in a laminated pane of a motor vehicle.
FIG. 7 is a cross sectional view through two asymmetric mutually decoupled high-frequency output lines on a pane antenna system of this invention.
FIG. 8 shows, in a sectional side view, three asymmetric, mutually decoupled high-frequency output lines in the pane antenna system of this invention.

FIG. 5 illustrates, in a sectional side view, an embodiment of a high-frequency output line which closely emulates a coaxial arrangement. A pseudo-grounding conductor 21 is arranged in close proximity to both opposite lateral sides of the pseudo-inner conductor 22. The conductors can be applied in a first printing process. In a further printing process is applied on the thus created conductors an insulating layer 23 having sufficiently good high-frequency quality with respect to the total damping for the effective wavelength and in a still further printing process a superposed conductive layer 21 is printed on the grounding layer 21 to form with the latter a pseudo-grounding conductor which surrounds three sides of the pseudo-inner conductor 22. In this manner, a very good decoupling between the effective currents of opposite phase in the thus constructed pseudo-coaxial high-frequency output line 10 and its environment and a high shielding effect is obtained. The resulting characteristic impedance of the output line depends strongly on the thickness of the insulating layer 23 and, in comparison with the embodiments of FIGS. 3 and 4, has a lowest ohmic value.

The pseudo-coaxial high-frequency output line 10 according to FIG. 5 is expensive however has a very high quality. This output line 10 has an additional advantage, because, due to its very high decoupling from the environment, its damping is not increased, when as indicated in FIG. 5, it is fully or partially covered by a bonding or adhesive layer or bead 32 having relatively poor bad high-frequency quality. Contemporary window panes for motor vehicles are frequently installed into the vehicle body by means of such adhesive beads. For reasons specific to motor vehicles, at least partially, an adhesive having a very high electrical conductivity is employed which at higher frequencies causes high losses when and electrical field penetrates the adhesive. Pseudo-coaxial lines shown in FIG. 5, as mentioned before, can be arranged under the layer of adhesive and therefore in the non-visible margin range of the window pane.

A substantially simpler embodiment from the aspect of printing technology is shown in FIG. 4. This pseudo-coaxial high-frequency output line 10 can be applied only in a single printing process and therefore is substantially less expensive. Nevertheless, it must not come in contact, especially with its pseudo-inner conductor, with adhesives having bad or poor high-frequency properties. Therefore, as indicated in FIG. 4, the conductors of the high-frequency output line must be arranged at a sufficient distance from the adhesive bead 32 on the pane. The resulting characteristic impedance of the output line depends both on the thickness of the printed on conductors and on the distance 31 therebetween. The thickness of a printed conductor is determined substantially by the sieve printing technology and can be varied only within very narrow limits; consequently, the characteristic impedance is adjusted essentially by the distance 31 between the parallel conductors.

Low characteristic impedances require small distances 31. In addition, small distances 31 produce a high concentration of electromagnetic field lines due to the proximity effect and consequently provide an improved decoupling from the environment. In practice, due to the limited sharpness of edges and due to limited resolution ability of conductors 21 and 22 printed by a sieve technology, the distance 31 cannot be selected arbitrarily small. A value of about 0.5 mm can be given as the lowest realization and reproducibility limit of the distance 31. Typical width for the pseudo-inner conductor 22 lie in the range of 1 to 3 mm and typical width for the pseudo-outer conductor 21 is between 5 to 20 mm. With these values, characteristic impedances between about 30 ohms to 100 ohms can be realized without major technological problems. As shown in FIG. 4*b*, the two pseudo-outer conductors of the printed output line of FIG. 4 should be interconnected at least at one end of the line. If the connection is at one end only, then due to the unloaded opposite end of the pseudo-outer conductor a capacitive shield is produced; if the interconnection is made at both ends of the output line, then there is provided also a shielding effect against magnetic fields.

A still simpler construction of the high frequency output line is shown in FIG. 3. It consists only of a single pseudo-inner conductor 22 and a single pseudo-outer conductor 21. Characteristic impedances achievable by this arrangement are in the range between about 50 to 250 ohms. The shielding effect and decoupling from the environment is naturally lower than in the arrangement of FIG. 4 but is sufficient for most practical applications.

FIG. 7 shows an arrangement of the output line based on the embodiment of FIG. 3. It includes two high-frequency output lines strongly decoupled one from the other and resulting from the provision of a pseudo-inner conductor 22 at each side of the pseudo-grounding conductor 21. The decoupling is larger, when the central conductor 21 is broader and the clearance 31 is smaller. This arrangement of conductors is employed for the pane antenna systems illustrated in FIGS. 11 and 14.

Based on the embodiments of FIG. 4 and FIG. 7, the example of FIG. 8 illustrates an arrangement for three mutually sufficiently decoupled high-frequency output lines.

Figure 9:
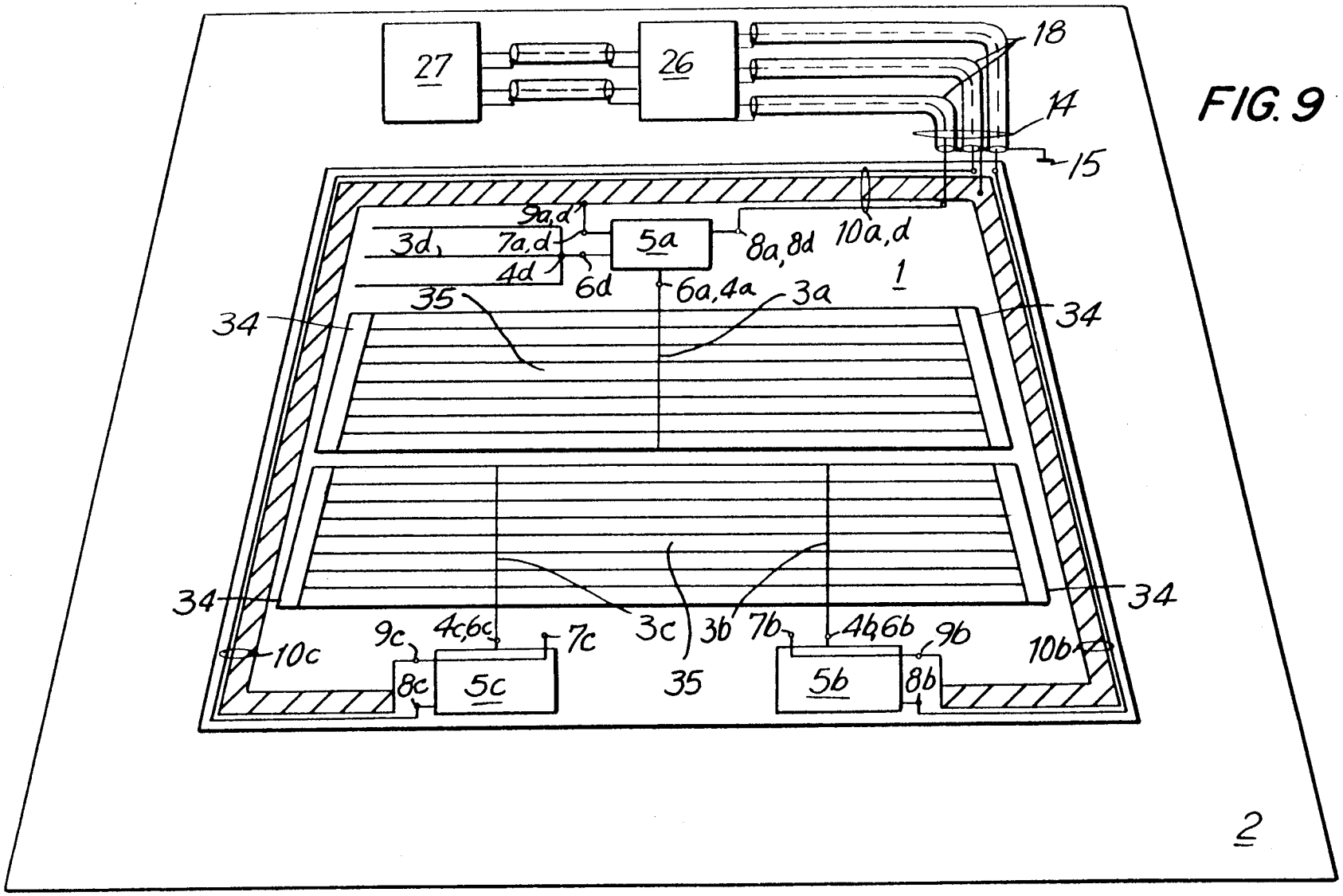
FIG. 9 shows, in an elevation view a pane antenna system of this invention including four antennas in combination with a printed circuit array of heating conductors and four-terminal networks to be used as an antenna diversity system in the UHF range and an additional frequency range.
Figure 10:
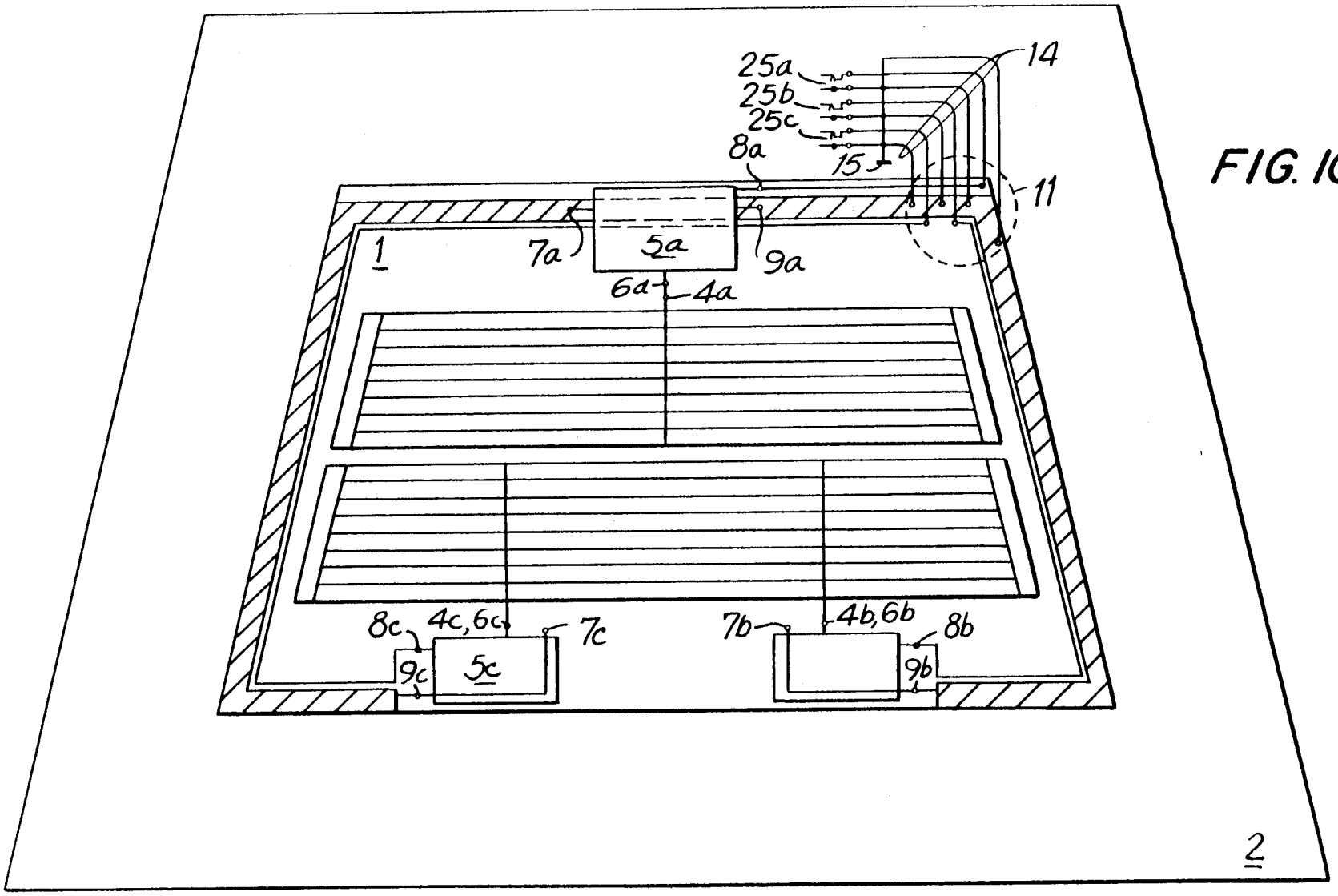
FIG. 10 shows a pane antenna system having three antennas according to this invention, for use either as an antenna diversity system or for the reception of different frequency ranges.

The above described high-frequency output lines printed on the window pane are illustrated in FIGS. 1, 2, 9, 10, 11, 12 and 13. In the following are described advantageous embodiments of antenna systems for panes provided with heating fields as illustrated in FIGS. 9, 10, 12, 13 and 14. In FIGS. 9 and 10, the collecting rails or bars of the heating fields are not electrically connected with the printed-on high-frequency output lines. In this arrangement, a relatively broad strip in the marginal range of the window pane is covered by conductor structures. Frequently, this marginal range is covered by a screen so that the conductor structures are not visible. In FIG. 9, the pseudo-inner conductor for the high-frequency output lines 10*b* and 10*c* is arranged outside the pseudo-outer conductor.

This arrangement is particularly suitable for window panes which are installed into the motor vehicle body by means of rubber joints, because the overlap between rubber joints and the pane is relatively small and generally exactly defined as to its width. If the pane is installed into the vehicle body by means of an adhesive layer it is to be taken into consideration whether the adhesive layer is applied immediately on the rim of the pane or at a distance from the pane rim. In the latter case the arrangement of FIG. 9 is more advantageous; in the former case, an arrangement according to FIG. 10 having a pseudo-inner conductor lying within the pseudo-outer conductor is usually more preferable. In principle the coating of the broad pseudo-grounding conductor with a layer of adhesive is substantially less critical than the coating of the pseudo-inner conductor.

Figure 12:
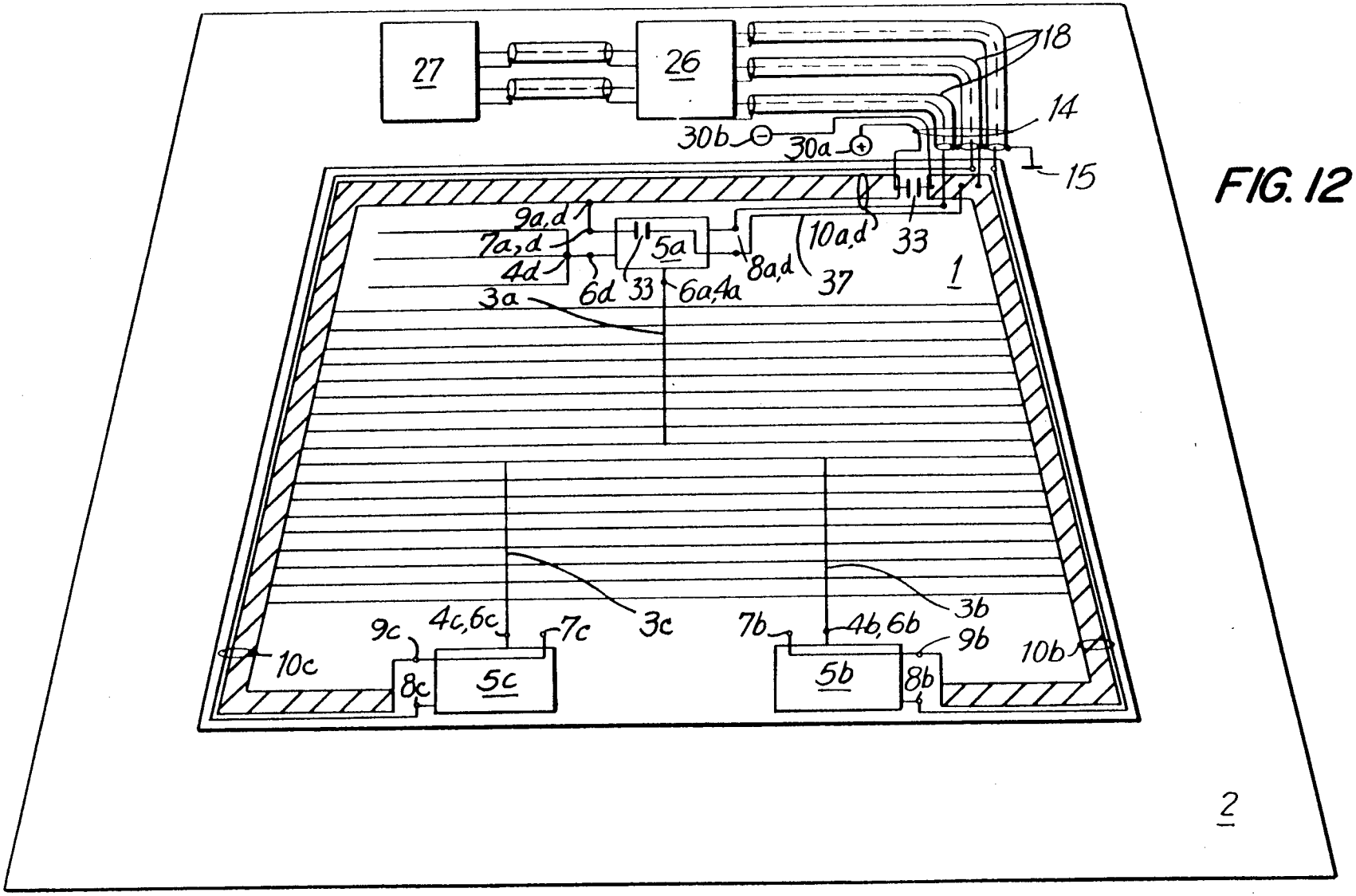
FIG. 12 is a pane antenna system similar to FIG. 9 wherein a part of the collecting bars for the heating array forms a pseudo-outer conductor of the printed on high-frequency output lines.
Figure 13:
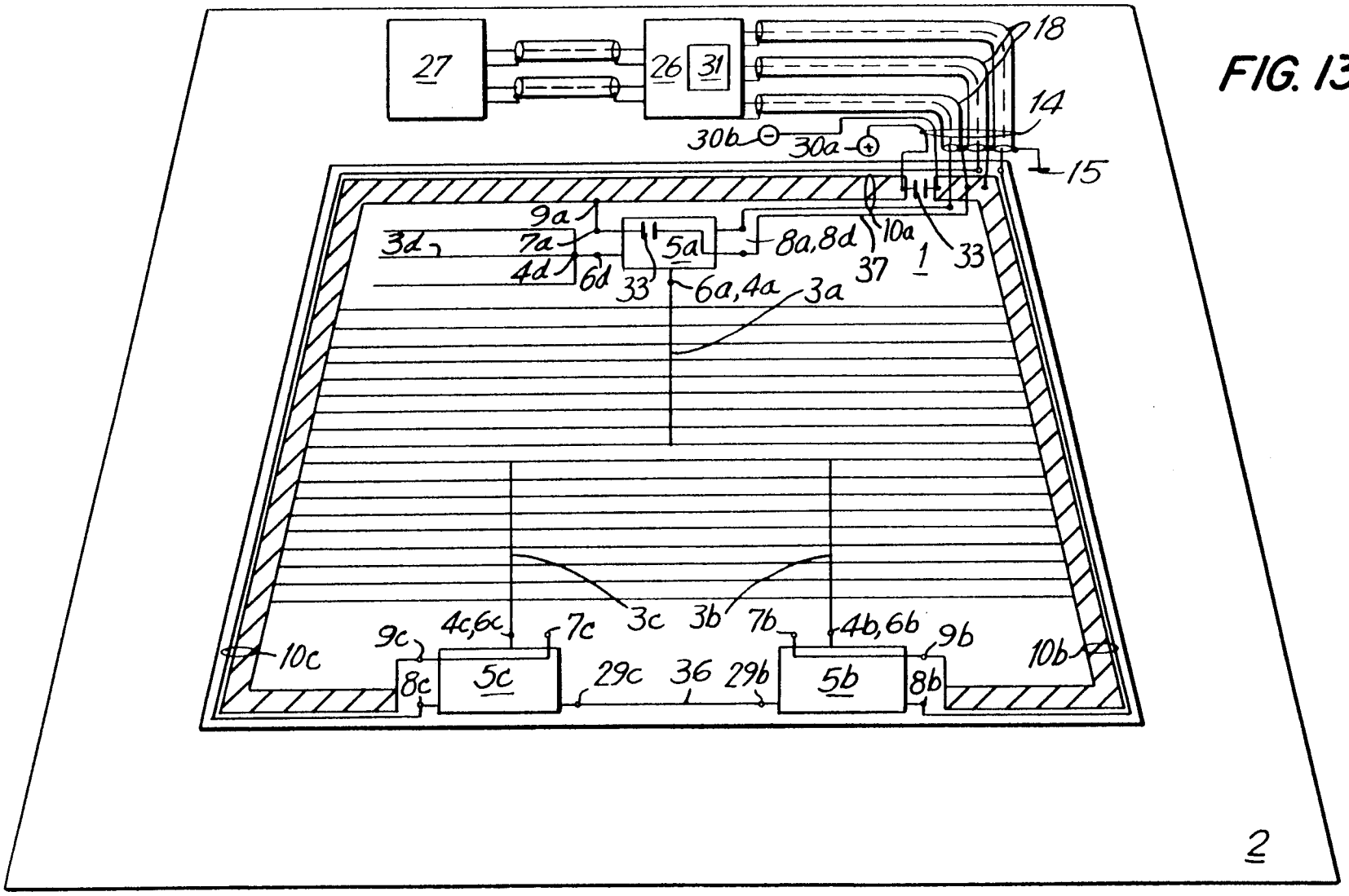
FIG. 13 is a pane antenna system similar to FIG. 10 but provided with active four-terminal networks and with additional conductors for supply voltages to the networks.

FIGS. 12 and 13 show preferred embodiments of the pane antenna systems of this invention for window panes provided with heating fields, in which the pseudo-outer conductor of the high-frequency output lines 10 form simultaneously the collecting rails or bars for the heating arrays or the field. In FIG. 12, the two four-terminal networks 5*c* and 5*b* for the antennas are passive networks and therefore no supply voltage is required. In the embodiment of FIG. 13, the four-terminal networks 5*b* and 5*c* are active networks and each requires a supply voltage.

The application of the heating current to the heating field in either FIG. 12 or 13 takes place via the pseudo-outer conductor of the high-frequency output lines 10 and via two conductors which form a component part of the cable strand 14 and to which the positive and negative voltage for energizing the heating field is supplied via power source terminals 30*a* and 30*b*. For frequencies of the effective frequency band the two pseudo-outer conductors of the high-frequency output line 10 are interconnected via the capacitor 33. In both FIGS. 12 and 13, it is assumed that the four example for the reception of long, medium and short wavelengths by the antenna conductor structure 3*d* and for the reception of the ultrashort wavelength range with the antenna conductor structure 3*a*, and therefore only a single high-frequency output line 10*a* is needed.

Especially for the reception of the long, medium and short wavelength range, a sufficient sensitivity is achievable only by an active antenna. Therefore, the four-terminal network 5*a*, at least for the long- medium-short wavelength range, is an active network which requires a supply voltage. In the examples of FIGS. 12 and 13, the positive supply voltage from the terminal 30*a* is applied via the pseudo-inner conductor of the high-frequency output line 10*a* and the negative voltage from the terminal 30*b* is fed through an additional conductor 37 which, as indicated in FIG. 13, is connected to the high-frequency output line 10*a*, 10*b* or arranged such that its high-frequency effect is substantially negligible.

In FIG. 13, the supply of the positive voltage for the active four-terminal network 5*b* takes place via the pseudo-inner conductor of the high-frequency output line 10*b*, and the supply of minus voltage takes place via the pseudo-outer conductor of the output line 10*b*. Since the pseudo-outer conductor of the high-frequency output line 10*c* at a switched-on heating field applies a positive direct current voltage and with the switched-off heating field a negative direct current voltage, it cannot be employed for supplying the negative voltage to the terminal network 5*c*. Instead, as seen in the example of FIG. 13, the negative supply voltage is fed via a separate conductor 36 between the power supply terminals 29*c* and 29*b*, and the positive voltage is supplied via the pseudo-inner conductor of the high-frequency output line 10*c*. The separate conductor 36 is again to be designed such that its high-frequency influence is substantially negligible. If such an adjustment is not possible, the conductor 36 becomes a part of the antenna system and must be taken into consideration as the remaining conductor on the non-conductive pane surface.

Referring to the side section in FIG. 6*a* and the plan view of the FIG. 6*b*, there is illustrated a high-frequency output line 10 for the antenna system of this invention arranged on a laminated window pane. In this example the pseudo-grounding conductor 21 is in the form of a thin metal sheet arranged between the two component panes 1*a* and 1*b* of the laminated or compound pane 1. The contacting with the output terminal 9 of the four-terminal network 5 is achieved with advantage in the manner as shown in FIGS. 6*a* and 6*b*, namely a conductor piece 24 is arranged laterally from the interface of the component panes and guided to contact the upper surface of the pane. The pseudo-inner conductor 22 is printed on the upper surface of the pane normal to the conductor piece 24 and terminated at a distance therefrom to produce an arrangement which in principle is known as a microstrip line.

In laminated glass panes, it is also possible to embed very thin coaxial cables or flat thin wire cables between the two component panes 1*a* and 1*b*, thus creating the high-frequency output line 10.

Antenna conductors are mostly sandwiched between two component panes 1*a* and 1*b* of the laminated pane. With correspondingly flat structures of the four-terminal networks it is possible to fit the antenna conductors, the antenna four-terminal network and high-frequency output conductor 10 between the two component panes. Of course, such a sandwiched arrangement has the disadvantage that a defective four-terminal network 5 is no longer accessible and cannot be replaced. Therefore such arrangements are suitable mostly for passive four-terminal networks having only a few components. In special cases, the antenna four-terminal network can be formed by a direct connection between the input terminal 6 and the output terminal 8, when, through a corresponding selection of the configuration of the antenna conductor 3 and of the kind and layout of the output line 10 and of the cable strand 14 up to the grounding point 15, the desired matching conditions can be obtained. The consideration as to the desirable matching condition for such passive antennas will be discussed below.

Active four-terminal networks are preferably arranged on the upper surface of the glass pane in order to preserve accessibility and exchangeability. The high frequency connection between the antenna conductors 3 arranged between the two component panes of the laminated pane, as well as the antenna conductor connection point 4 and the input terminal 6 of the four-terminal network 5 also arranged between the component panes, can be achieved in conventional manner by a capacitive coupling through the separating component panes in such a way that flat juxtaposed conductor structures are employed which together with the dielectric constant of the glass pane provide a sufficiently high capacity. The high-frequency output line 10 is realized preferably in accordance with FIG. 6 or can be printed on the outer pane according to FIGS. 3 or 4.

As seen in FIG. 1, the high-frequency output line 10 is connected with conductors 21 and 22 to the two coaxial cables 18*a* and 18*b* in the collecting or interconnecting region 11. The initial portion of the cable strand leads from the non-conducting surface toward the vehicle body 2. If the non-conductive surface is in the form of the rear trap door of a motor vehicle, then the cable strand is preferably tied in cable harnesses provided for other electrical conductors mostly in the neighborhood of the hinges for the rear door.

In this arrangement according to the invention, it is of a special advantage that only at a single region, in the case of the embodiment of FIG. 1, in the upper right hand corner of the pane, an interconnection between the antenna system on the pane and the transmission lines on the vehicle body are needed.

In contrast, prior art antennas necessitate separate and as short as possible grounding connection from each of the four-terminal networks 5 to the conductive vehicle body. As regards the permissible length of these grounding connections for prior art antennas this will be mentioned below.

The prior art antennas require a grounding point in the immediate vicinity of each of the four-terminal networks. Therefore, the configurations of antennas and installation locations for the four-terminal networks must be selected considering the limiting features of the particular motor vehicle involved. The required grounding points are only available at a limited number of locations in each individual motor vehicle. Therefore, the prior art antenna constructions, in spite of the good efficiency of their antenna conductor, cannot frequently be utilized.

When a plurality of the prior art antennas are to be installed on a non-conductive surface, for example, on a window pane of the motor vehicle, the availability of the grounding point for each four-terminal network of the antenna must be guaranteed. With regards the antenna systems for antenna diversity applications, the antenna structures and their four-terminal networks cannot spatially be concentrated in a narrow range of the window pane in order to obtain a most diversified operation with respect to the time of reception of interferences with the individual antennas, but must be distributed over the entire surface of the pane to achieve a good diversity effect. The possible improvement of the reception through the antenna diversity increases with the number of antennas available for the diversity system. Therefore, it is desirable to provide as vehicle antennas as can be realized at acceptable cost.

Accordingly, for the installation of conventional pane antennas, it is necessary to make available around the periphery of the window pane a number of grounding points in the vehicle body corresponding to the number of individual antennas. The feasible number of diversity antennas on a window pane is therefore frequently limited by design aspects of the motor vehicle. For each antenna of the prior art system, a conductor bridge between the window pane and the vehicle body was necessary. The conductor bridges, in the case of the installation of the antenna four-terminal networks on the pane, are constituted by the grounding connection and the high-frequency output line or in the case of the installation of the four-terminal network on the vehicle body, by the connection between the connection point of the antenna conductor on the pane and the input of the four-terminal network. Therefore, a conventional "antenna system" for a manufacturer of motor vehicles consists of the window pane and a plurality of antenna four-terminal networks and grounding connections to be individually installed.

The introduction of plastic component parts in the motor vehicle technology, for example, a broad plastic frame having the rear window pane in the trap door of a station wagon, causes particular problems when it is desired to provide several antennas in the tailgate of a station wagon inasmuch as the possibility of the grounding connection in the immediate vicinity for all antenna four-terminal networks via sufficiently short grounding conductors is not available. In such cases, to insure a short connection with a corresponding grounding point, the antenna four-terminal networks must be applied on the vehicle body at a relatively large distance from the connection point of the respective antenna conductors. Consequently, the distance between the antenna conductor connection points on the pane and the input terminals of the antenna network must be bridged by correspondingly long connection wires.

Therefore, the construction principle of active antennas having the shortest possible conductor between the four-terminal network and the antenna conductors on the pane, to achieve the advantage of maximum possible signal to noise ratio, can be realized in prior art systems only insufficiently. This drawback occurs essentially in all frequency ranges. Particularly serious are these disadvantages at relatively low frequencies of the long, medium or short wavelength range, when an antenna amplifier with a capacitive, high impedance input is used. In the latter frequency range, a longer connection wire acts as an additional capacitor with respect to the vehicle body and the additional capacity has a disadvantageous effect for the electrically short antennas with a correspondingly small antenna capacity. If these connection wires run parallel to other unshielded lines in the motor vehicle, then undesired interfering coupling between the vehicle power supply and the inputs of the four-terminal network may result.

Evidently, such long connection wires are disadvantageous for each of the individual antennas of the system. If the connection wire is run for example, parallel to the upper surface of the plastic component parts which surround the pane (for example attached on the upper surface of the plastic component or embedded therein), then further disadvantages would result provided that the loss of the plastic material or the respective frequency ranges is not sufficiently small. Plastic materials used in the contemporary construction of motor vehicles have such high dielectric losses for the frequencies of the ultrashort wavelength range that connection wires alone, which run in the proximity to the upper surface of the plastic, cause high signal damping, so proper functioning of the prior art antennas frequently cannot occur to the extent that is required.

For the above reasons such long connecting wires are, in principle, disadvantageous even for single antennas. For antenna systems having a plurality of antennas, such as antenna diversity systems, there occur additional negative consequences when the connection wires of the plurality of antennas run parallel to each other. The resulting undesired coupling reduces the diversity of operation of the individual antennas with the concomittant reduction of the diversity efficiency.

The above disadvantages are substantially eliminated in the antennas of this invention since the four-terminal networks 5 of the antenna system exhibit only a single common grounding bridge to the conductive vehicle body 2 at the ground point 15 and the high-frequency connections between the four-terminal networks and the interconnection region 11 are realized by coaxial lines or pseudo-coaxial lines which are applied on the window pane or between the component panes of a laminated pane. Since the cable strand from the interconnection region 11 to the vehicle body consists of coaxial cables or of electrically similar pseudo-coaxial cables, an advantage is achieved for the antennas of this invention, since no untolerable coupling between signals of the individual antennas occurs. Also, there results no interfering coupling with other parallel conductors, for example with conductors which supply heating currents to the heating array on the window pane.

The common grounding point 15 of the antenna system of this invention is remote from the output terminals of the four-terminal network 5 at a distance which is not negligible for high-frequencies. In this connection, the term "not negligible for high-frequencies" means that the active four-terminal network 5 is not connected to the grounding point 15 via a standard low impedance for high-frequencies which is negligible for antenna systems.

Figure 2:
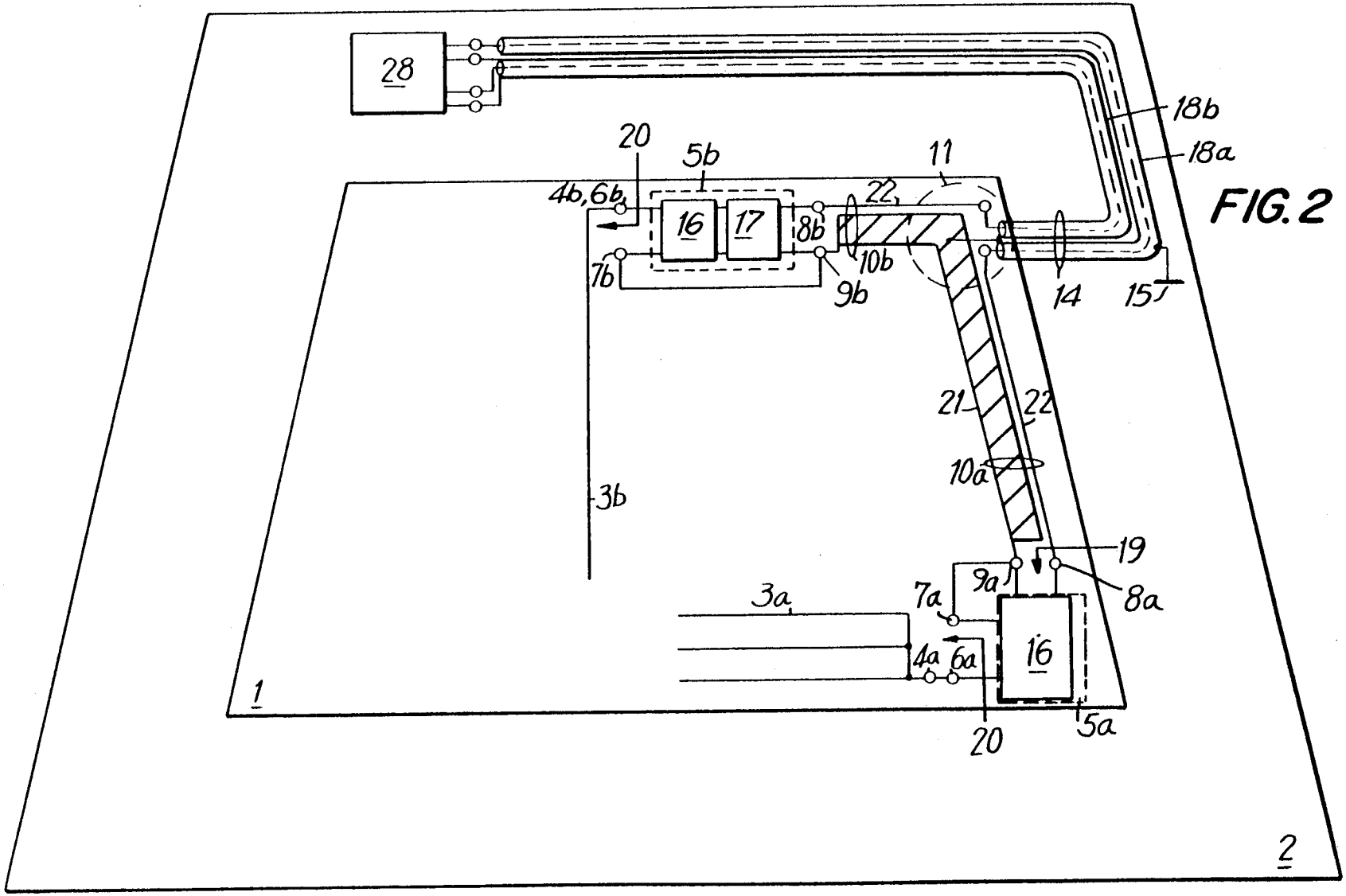
FIG. 2 show is a modification of the antenna system of FIG. 1 having a passive four terminal network and an active four terminal network.

In FIG. 1, this situation occurs for both four-terminal networks 5*a* and 5*b* when the plastic frame 12 surrounding the window pane 1 has a width which makes the distance between the output terminals 8*b*, 9*b* of the network 5*b* and the grounding point 15 no longer negligible for high frequencies. In the embodiment of FIG. 2, no plastic frame 12 of this kind is present and the distance between the output terminals 8*b*, 9*b* of the network 5*b* and the grounding point 15 is so small that it can be disregarded for high frequencies. In either case (FIGS. 1 and 2), the four-terminal network 5*a* is spatially remote from the four-terminal network 5*b* and a high-frequency output line with the conductors 21 and 22 is necessary for bridging this spacing. The spacing between the output terminals 8*a* and 9*b* of the network 5*a* to the interconnection region 11 and the grounding point 15 is consequently of such a length that it is no longer negligible for high-frequencies.

In the following description, the term "a non-negligible length for high-frequencies" will be further explained. In prior art antennas, the grounding connection is structured to have as low an impedance as possible Preferably, in the car industry, flat metal parts are used which are screwed to the vehicle body to establish an almost ideal grounding connection and at the same time to mechanically fix various components. If this is not possible for some reason or other, there are employed the so-called grounding bands for the ground connection, that is short conductors in the form of conducting mesh. The purpose of this measure is to minimize voltages resulting from surface currents flowing along the grounding connection to the vehicle body.

In the prior art antennas, the input impedance of the antenna amplifier is determined exclusively by the antenna conductor in combination with the part of vehicle body surrounding the window pane and having a ground reference point which is determined by the grounding connection of the amplifier. If the impedance of this grounding connection is antennas of this invention then there results a non-negligible change in the impedance of the passive part of the antenna. The impedance of the passive part is for high frequencies in series with the impedance of the antenna conductor which would occur at an ideal low impedance grounding point and changes the latter accordingly.

The permissible impedance of the grounding connection of prior art antennas depends therefore on the impedance of the antenna conductor having an ideal low impedance grounding point. The lower is the impedance of the antenna conductor, the lower impedance of the grounding connection is to be required.

Frequently, antennas are designed for broad frequency ranges. This applies almost without exception for active reception antennas which are supposed to operate over broad bands in the ultrashort wavelength band, in the long, medium or short wavelength band or the wavelength bands of television, VHF and UHF. Antennas structures designed to have a high impedance, for example lambda/2, long conductor configurations unloaded or open at one end do not exhibit such a high impedance over short frequency ranges. Therefore, for broad band antennas it is necessary to add the lowest possible impedance value occurring within a frequency band in order to determine the permissible impedance of the grounding connection for conventional antennas.

For explanation of the resulting effects, the following example is to be considered. Assuming a grounding connection by means of a standard grounding band of a conductive mesh having a cross-section 6 times 1 mm, then the inductive surface reactance of this grounding band is about 8 nH/cm. With further reference to a passive antenna and an output line having a standard characteristic impedance of 50 Ohms and assuming that the antenna conductor is constructed such as to have an impedance of 50 Ohms with a a standing wave ratio of 2 for the passive antenna, then a minimum real impedance value of 25 Ohms will result.

If in this example, one tolerates a series connected impedance of j25 Ohm so that a total impedance has a 45° phase shift due to the grounding band, then the permissible length of the ground band is about lambda/60. For the example of an ultrashort wavelength range having a wavelength of 3 meters, the corresponding maximum permissible length of the grounding band is about 5 cm.

In the examples of the antennas of this invention illustrated in the drawings, the antenna conductor connection 4 is always directly connected to the input terminal 6 of the four-terminal network 5. The antenna conductor connection point 4 and the input terminal 6 are required to be separate physical entities only in certain exceptional cases. In practice, both connection points are mostly identical. A "direct" connection takes place also at non-identical connection points as long as the high-frequency properties, for example the impedance matching conditions, such as the capacity load of the antenna conductor 3 at the antenna conductor connection point 4, are not unduly changed by this connection.

The high-frequency connections of the output terminals 8 and 9 of the four-terminal network 5 to the interconnection region 11 on the pane and of the initial part of high-frequency lines 18*a* and 18*b* in FIG. 1 forming a component part of the cable strand 14 are up to the ground point 15 in the antennas of this invention, a component part of the passive antenna portion because, apart from the currents in opposite phase of the high frequency output from the four-terminal network 5, they conduct also direct currents flowing at ground point 15 to the vehicle body 2. If the high-frequency lines 18 of the cable strand 14 are in the form of coaxial cables, which run at a minute distance parallel to each other and which are held together, for by an insulating sheet, then the high frequency capacity coupling of these coaxial cables is high and it suffices, as indicated in FIG. 1, to connect to ground only the conductive outer jackets of the coaxial cables.

If the high-frequency lines of the cable strand 14, as shown in FIG. 10, are formed by a flat ribbon-like cable formed with alternating pseudo-outer conductors and pseudo-inner conductors, then the high coupling between the individual pseudo-outer conductors is reduced and it is recommended to connect the pseudo-outer conductors, either for high frequencies only or by a electrical connection, with each other at the ground point 15 and all connect for high-frequencies with the grounding connection. The ground point 15 for high frequencies has a low impedance connection point on the conductive vehicle body 2, and its position is selected with respect to considerations specific for each motor vehicle.

If it is possible to select among different ground points then it is, as a rule, preferable to select a ground point which is closest to the interconnection region on the non-conductive surface. This preference results from the fact that the high-frequency conductors between the four-terminal networks and the ground point 15 are a component part of the antenna and therefore must be weighed in a definite manner which requirement can be more easily fulfilled with short length. Under these circumstances, simpler running of the cable strand 14 under specific conditions in a motor vehicle or with respect to the antenna operation may result in the selection of a remote ground point 15.

Similarly, it may be also of advantage in the antennas of this invention, as shown in FIG. 10, to provide an intersection with alternating types of the transmission lines, for example, changing from a flat band cable to a coaxial cable (25*a* through 25*c*). The alternating type of arrangement of this kind has the advantage that, for the contacting on the window pane, multiple plug connectors known for example, from the ribbon cables in the computer technology, can be used. In FIG. 10, such a multiple plug connector can be provided in the interconnecting region 11 to which the cable strand 14 is connectable. As a rule, to avoid reflections at the transition points, the sections of the transmission line of the different type are used which have the same characteristic impedance.

In most instances however, the same type of transmission lines such as illustrated in FIG. 1 is employed, preferably thin, flexible coaxial cables between the interconnection region 11 and the ground point 15 and in the further extension.

In the following description criteria for the matching of the input and output of the antenna four-terminal network 5 will be discussed.

For matching the input impedance of the four-terminal networks 5 through the feeding impedance 20 of the antennas of this invention, conventional impedance matching devices with high-frequency output lines are used, whereby the input of the devices is connected to the input terminals 6 and 7 and, when the four-terminal network is to be short circuited, the terminals 8 and 6 are directly connected one with the other.

Both the feed impedance for the respective four-terminal networks as well as the excitation and thus the signal strength depend on the geometry and position of the antenna conductor 3 as well as on the arrangement of the high-frequency output line 10 on or within the window pane, on the length of the high-frequency transmission cables 18 laid between the interconnection region 11 and the ground point 15 and on the position of the ground point 15 on the vehicle body 2.

According to the operational efficiency of the passive antenna parts, the four-terminal network for the antenna can be either passive or active. As known, when using the active antenna, a distinct advantage results from the fact that the achieved signal to noise ratio is substantially higher than is the case in passive antennas. Especially in pane antenna systems, further advantages are obtained when using active individual antennas in that, due to the minute feedback of modern active building blocks, only a negligible influencing of the input of the assigned four-terminal network by the wiring of the output circuit of the network takes place. A change of the load at the output of the antenna four-terminal network occurring, for example, during the switch over between the individual antennas of an antenna diversity system, produces therefore no feedback or reactive effect on the antenna structures alone.

In the embodiment of FIG. 2, the network 5*b* is an active four-terminal network and has, apart from the active structural block 17, a preliminary transformation block 16 of low loss reactive elements which, in combination with the configuration of the antenna conductor 3*b* and the high-frequency output line 10*b* and the output transmission line 18*b* up to the ground point 15, determine the matching condition at the input terminals 6*b* and 7*b* of the four-terminal network 5*b*. The matching leads to an optimum signal to noise ratio in the effective frequency range at the output terminals 8*b* and 9*b* of the active four-terminal network 5*b*. Efforts should be made to make the requisite passive transformation stage 16 in the network 5*b* as simple as possible by the corresponding configuration of the antenna conductor 3*b* and of the high-frequency output line 10*b* and of the initial portion of the transmission line 8*b* up to the ground point 15.

In the case of a passive four-terminal network 5*a* in FIG. 2 it is desirable to provide a suitable matching condition with respect to the input of the receiver 20*a*. Suitable matching conditions can be, for example, the impedance ratios which lead to an optimum efficiency or to an optimum signal to noise ratio.

In practice, it is desirable for achieving predictable operating conditions to use matched high-frequency transmission lines 18; that means to use source and load impedances which correspond to the characteristic impedance of the high-frequency lines 18. Consequently, the impedance matching conditions are independent from the length of the connecting cable between the ground point 15 and the input of the receiver. For the same reasons, no jump on the characteristic impedance between the respective high-frequency output lines 10 and the assigned high-frequency transmission line 18 should be present.

The impedance matching at the input of the receiver (load impedance at the input of the receiver is equal to the characteristic impedance of the high-frequency transmission lines) is then equivalent to a corresponding reflection-free matching between the output terminals 8*a* and 9*a* of the four-terminal network 5*a* and the assigned high-frequency output line 10. The impedance 19 must be in a range which does not prohibitively deviate from the characteristic impedance of the high-frequency output line 10*a*. This is achieved by a suitable configuration of the antenna conductor 3*a* of the high-frequency output line 10*a* and the output transmission lines 18*a* to the ground point 15 as well as of the transformation stage 16 consisting of low loss reactance elements in the antenna network 5*a*. Also, in this case, efforts should be made to realize the transformation stage 16 in a most simple fashion.

Of course, the antenna systems of this invention can be designed exclusively for a single frequency range, for example for the reception of ultrashort wavelength broadcasting for antenna diversity systems.

Nevertheless, the antenna systems of this invention can contain one or more antennas for the reception of different wavelength ranges, for example, a single antenna for the reception of the low, medium and short wavelength range; one, two or more antennas for the reception of the ultrashort wavelength and one, two or more antennas for the reception of the television VHF and/or UHF range. It is possible also to use the antenna conductor 3 for a single frequency range only or for the reception of several frequency bands.

A typical advantageous application of the antenna arrangement of this invention are antenna diversity systems in which a selection circuit 26 in the form of a diversity processor is required which passes one of the signals available at the network 5 through to the receiver 27. Between the receiver 27 and the selection circuit 26 connected as a diversity processor, a further connection from the radio to the diversity processor is necessary in addition to the high-frequency connection. This further connection can be, for example, a coaxial cable through which the actual interfrequency signal from the receiver 27 is fed to the diversity processor 26 to derive signals which influence the switch over to an antenna having no interference. If in the selection circuit 26 only a high frequency switch is present, then this further connection can be in the form of a digital control line which initiates the switch over to a non-disturbed signal receiving antenna.

Depending on the size of the selection circuit and on the number of four-terminal networks employed in the antenna diversity system, the selection circuit 26, as indicated in FIG. 9, is located in the range of the body 2 and a separate high-frequency transmission line 18 is run to the input of the selection circuit 26. In the example of FIG. 9, the cable strand 14 includes three coaxial cables 18.

Figure 11:
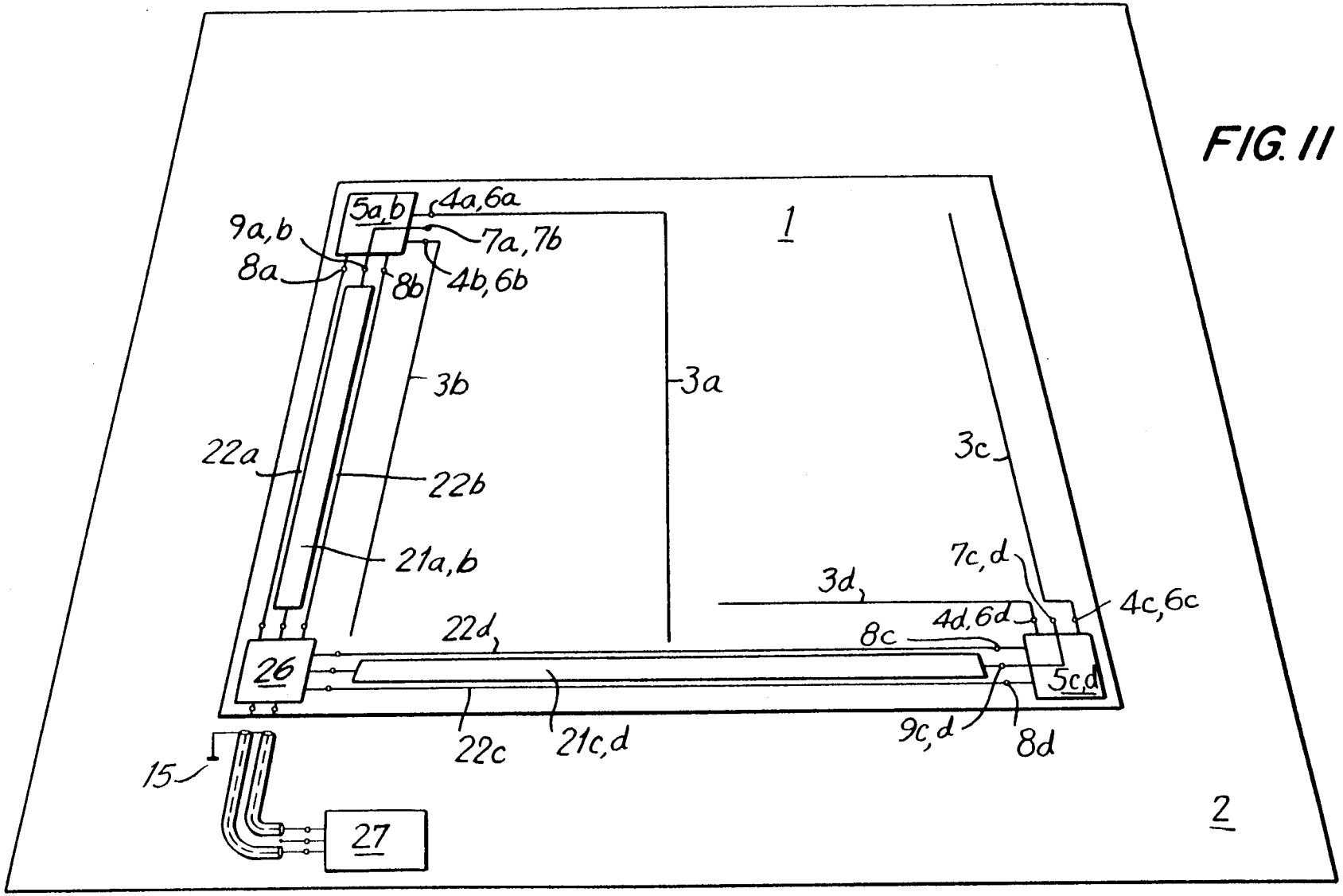
FIG. 11 is another embodiment of the pane antenna system of this invention with printed on four antennas, four high-frequency output lines and a selection circuit acting, for example, as a diversity processor.

If the selection circuit 26 is arranged on the non-conducting surface as indicated in FIG. 11, the cable strand then includes only two high-frequency lines (two coaxial cables leading to the receiver 27 in FIG. 11) or only of a single high-frequency line and a digital control line. In this configuration of the antenna system of this invention, the outer conductor of the high-frequency transmission cable between the selection circuit and the receiver is connected for high-frequencies with the ground point 15 located at a suitable point on the car body. The collecting or the interconnection region 11 in the arrangement of FIG. 11 is identical in this embodiment with the inputs of the selection circuit 26.

In the following description the embodiments of the high-frequency connection to the ground point will be explained.

Figure 15:
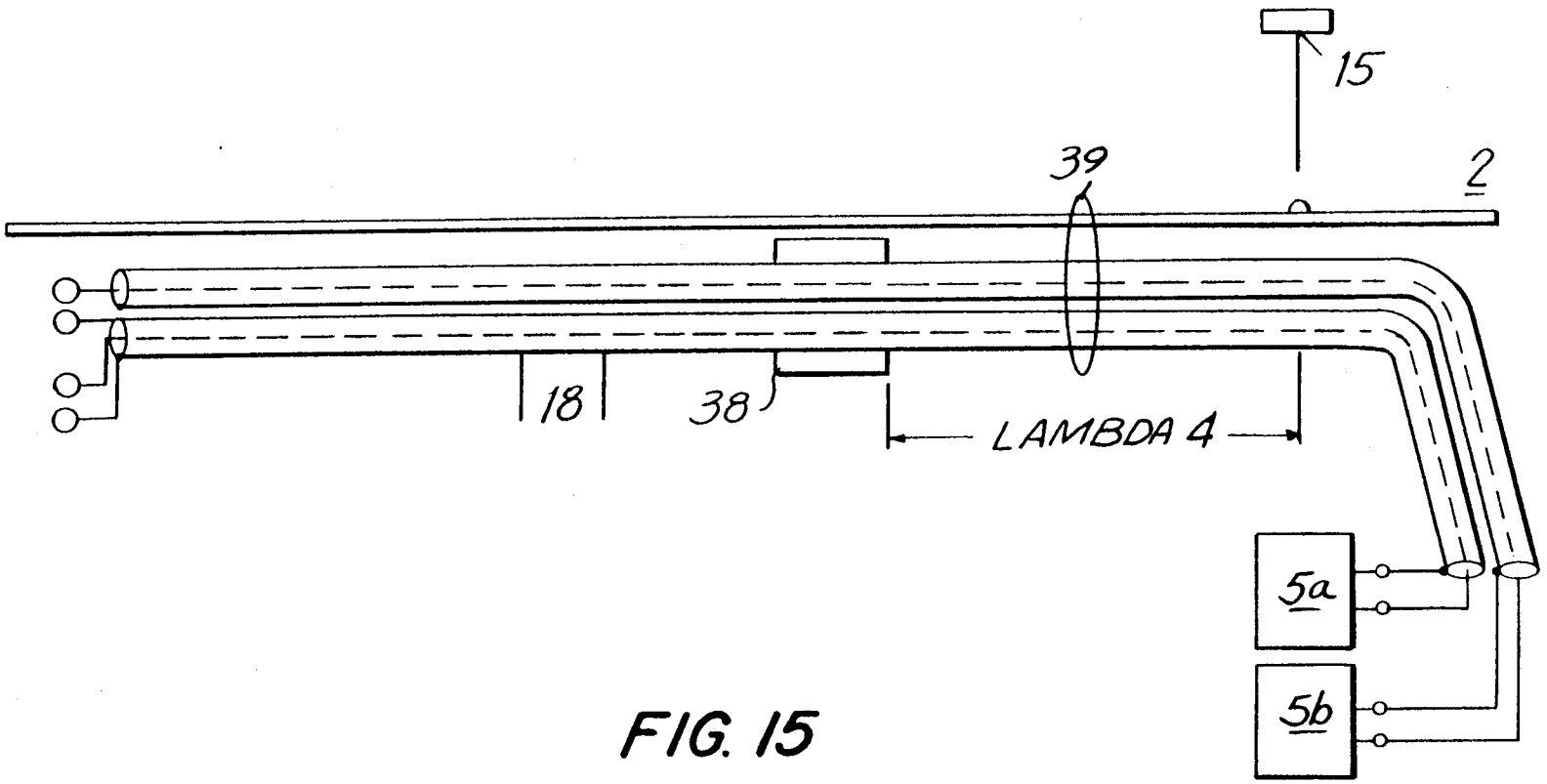
FIG. 15 shows a development of a coupling to a grounding point by means of ferrite sleeves inserted on the strand of transmission lines at a distance of $\frac{1}{4}$ of mean wavelength from the grounding point.

Such a high-frequency conducting connection for example, between the outer conductor of the coaxial cable 18 or of the pseudo-outer conductor of a flat band line with the ground point 15 is effected by a short galvanic connection, for example, by a screw connection to the metallic car body. As shown in FIG. 15, the low impedance connection for high frequencies to the ground point 15 can be also made by means of a ferrite sleeve 38 which is inserted on the output transmission line 18 and shiftable in a range relative to the ground point which is remote from the four-terminal networks 5 of the antenna. The ferrite sleeves preferably have a damping effect on in-phase currents in the high impedance broad band output transmission line. In the example of a coaxial output transmission arrangement 39 including outer conductors of coaxial cables 18 of a cable strand 14 on the one hand, and a conductive environment which consists substantially of the car body 2 on the other hand, there results in the region of the ferrite sleeve a no load condition of the transmission arrangement. The same effect occurs in the case of twin wire cables. The no load or open end condition is transformed in conventional manner according to the characteristic impedance of the thus created transmission line arrangement 39. For a length of about a quarter of the effective wavelength (lambda/4) between the ground point 15 and the range of the ferrite sleeve 38, there occurs in this manner a high-frequency short circuit to the ground point 15 for a single frequency. For the neighboring frequencies, there results a low impedance. The lower the impedance at the ground point 15 within an effective frequency band is, the higher is the impedance introduced by the ferrite sleeve for the damping and the lower is the characteristic impedance of the transmission conductor arrangement 39. The high impedance of the throttling or damping region is obtained by a suitable selection of the ferrite material. The characteristic impedance of the transmission line arrangement 39 is preferably made low, for example, by running the coaxial cables 18 of the cable strand 14 in the range between the ground point 15 and the ferrite sleeve at a small distance above the conductive surface of the car body 2. In the shown examples of the antenna systems of this invention having coaxial cables 18 in the cable strand 14, the outer jacket or sheath of the cable 18 is galvanically connected with the ground point 15. For this purpose the isolation of at least one coaxial cable 18 is stripped off at this point. In many cases, such cutting of the insulating sleeve is not desirable. With advantage in the antennas of this invention the stripping of the insulation can be avoided when an additional conductor 40, for example, in the form of a grounding band of a suitable cross-section is laid parallel to the cable strand 14 and to perform the same function.

The conductor 40 is at one end thereof connected with the outer conductors or pseudo-outer conductors at the interconnection region 11 and at its other end is connected with a low impedance for high-frequencies with the grounding point 15. The cable strand 14 having the grounding conductor 40 is preferably enclosed in a further insulating layer. In this manner there results a well defined capacitive and low impedance coupling between the conductor 40 and the outer jacket of the coaxial cables 18 with an electrically equivalent operation.

Figure 14:
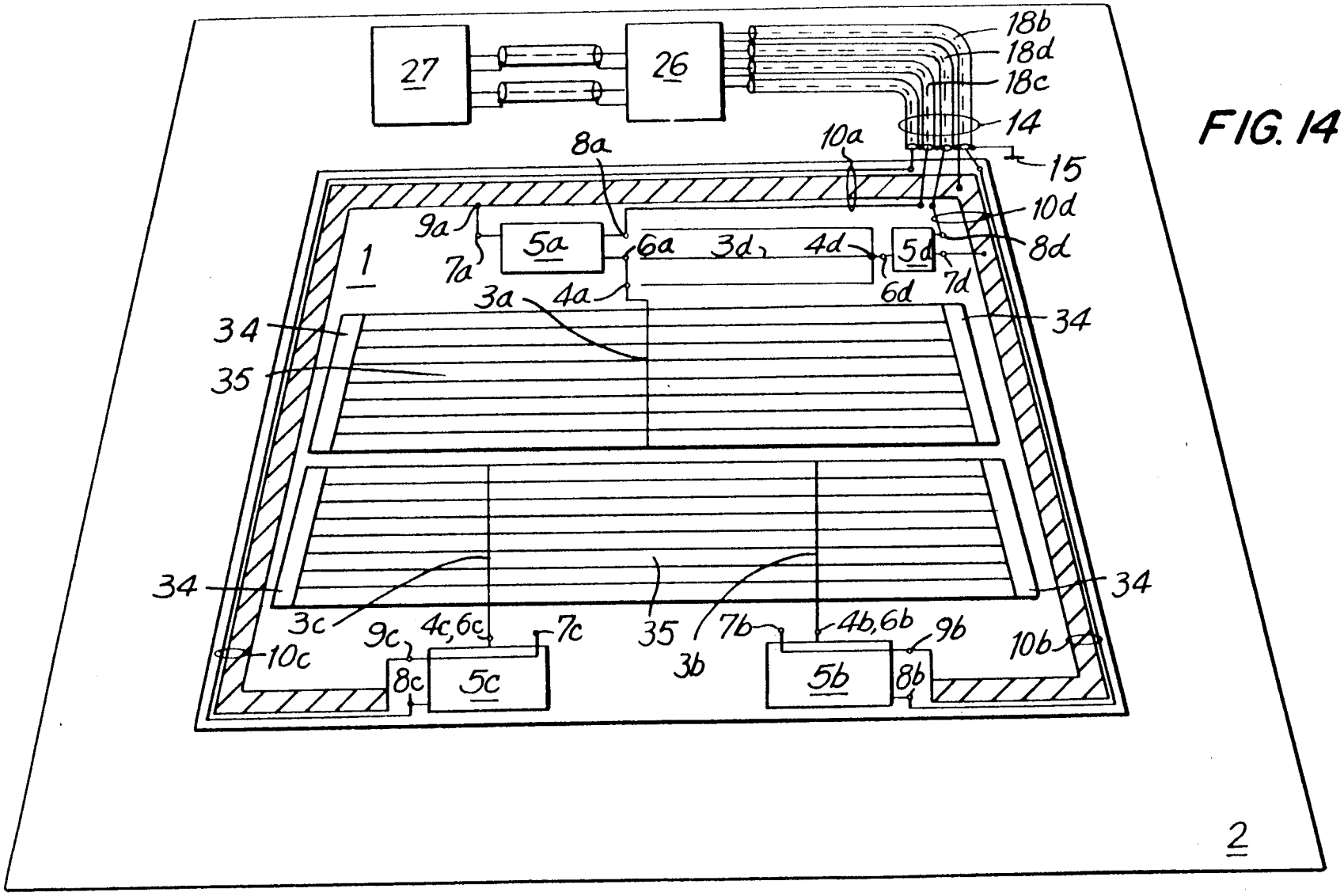
FIG. 14 is another embodiment of the pane antenna system of this invention in combination with a printed on heating array and with four active four-terminal networks.

FIG. 14 shows an antenna system of this invention having four antennas arranged on a non-conductive surface, in this example, on a window pane 1 which is directly installed in the conductive car body 2. Accordingly, the four-terminal networks 5 mounted on the pane 1 are located in proximity to the conductive car body 2. In order to provide a grounding attachment for each of the four-terminal networks 5*a* through 5*d*, the present invention eliminates the prior art arrangement in which a grounding band must have been provided between each of the networks 5 and the car body and being mechanically connected to the latter or, in the case of an installation of the four-terminal network in the car body, eliminates a separate connection of each antenna conductor connection point on the pane to the input of the antenna four-terminal network. It is evident that this invention eliminates the need for such a plurality of conductive bridges and provides substantial advantage of a higher adaptability of the antenna systems for installation on non-conductive surfaces.

What is claimed as new and desired to be protected by Letters Patent is set forth in the appended claims:

1. An antenna system comprising at least two antennas for frequencies up to an ultrahigh-frequency range, the antennas being arranged on a non-conductive sheet framed by a metal body of a motor vehicle, and each antenna having at least one antenna conductor, said antenna conductor being secured with the non-conductive sheet, each antenna also having a connection point on the antenna conductor and each antenna also having a four-terminal network having two input terminals and two output terminals, each of said four-terminal networks being supported by the non-conductive sheet and said four-terminal networks not being spatially concentrated in a portion of the non-conductive sheet which is small compared with the entire non-conductive sheet, each of said connection points being coupled to one input terminal of the respective four-terminal network via a short conductor having an impedance and a length which is small compared with the wavelengths of said frequencies so that the impedance of said short conductor for said frequencies is negligible, the other input terminal of the respective four-terminal network being connected to one output terminal thereof; at least one high-frequency output line, each consisting of at least two output line conductors, each of said at least one high-frequency output line being supported by said non-conductive sheet and being connected at at least one end thereof to the output terminals of one of said four-terminal networks, each of said output terminals of said one of said four-terminal networks at the at least one end of said high-frequency output line being connected to one of said output line conductors, and each of said at least one high-frequency output line extending to an interconnection area located in the vicinity of the metal body on the non-conducting sheet; a ground point provided on the metal body; a single cable of at least two transmission lines extending on said metal body and having an initial cable portion extending into said interconnection area; and each of said output line conductors of said at least one high-frequency output line being connected to at least one of the transmission lines of said cable, and means connecting the other of said four-terminal networks to one of the transmission lines of said cable.

2. An antenna system as defined in claim 1, wherein said ground point on said metal body is arranged in immediate proximity to the cable of transmission lines and being connected at a low impedance for high-frequencies with outer conductors of the transmission lines.

3. An antenna system as defined in claim 2, wherein the four-terminal networks consist of passive low loss reactance elements for matching the output impedance of the four-terminal networks to an input impedance of a receiver.

4. An antenna system as defined in claim 2, wherein said four-terminal networks include active amplifying stages and low loss passive stages connected between a connection point of an assigned antenna conductor and the active stage, the passive stage including low loss reactance elements for matching output impedance of the corresponding four-terminal network to improve signal to noise ratio in an effective frequency range.

5. An antenna system as defined in claim 1, wherein said non-conductive sheet consists of a window pane of a motor vehicle enclosed in a plastic frame.

6. An antenna system as defined in claim 1, wherein said non-conductive sheet is a window pane installed in the metal body of a motor vehicle.

7. An antenna system as defined in claim 6, wherein the antenna conductors, the connection points of the antenna conductors, the four-terminal networks, the at least one high-frequency output line and the interconnection area are secured to the window pane.

8. An antenna system as defined in claim 7, wherein the at least one high-frequency output line is applied on the window pane of the motor vehicle by a sieve printing process.

9. An antenna system as defined in claim 8, further comprising a heating field with current collecting bars printed on the window pane and printed-on conductors of the at least one high-frequency output line extending in the region between the current collecting bars and the rim of the pane and are decoupled from the collecting bars.

10. An antenna system as defined in claim 8, further comprising an undivided heating field having two current collecting bars, and one of said bars forming a conductor of the printed on at least one high-frequency output line.

11. An antenna system as defined in claim 4, wherein the active stages of the four-terminal networks are power supplied via conductors of the at least one high-frequency output line and of the transmission lines.

12. An antenna system as defined in claim 4, wherein the active stages of the four-terminal networks are power supplied via additional conductors arranged in the cable of the transmission lines.

13. An antenna system as defined in claim 6, wherein the window pane of the motor vehicle is a laminated glass pane, at least one of the four-terminal networks being arranged on the glass pane and the corresponding antenna conductor being sandwiched between component panes of the laminated glass pane and the coupling between the one input terminal of the four-terminal network and the antenna conductor connection point being established by a capacitive coupling through the glass pane.

14. An antenna system as defined in claim 1, wherein all of the antennas are designed for the same frequency range.

15. An antenna system as defined in claim 1, wherein the antennas of the antenna system are designed for different frequency ranges.

16. An antenna system as defined by claim 1, wherein the connecting means is a separate transmission line in the single cable connected via the interconnection area to the output terminals of the other of said four terminal networks.

17. An antenna system as defined in claim 1, further comprising a receiver arranged on the metal body of the vehicle, a selection circuit arranged on the non-conductive sheet and having inputs connected via said at least one high frequency output line to the output terminals of said four-terminal networks, and outputs connected via a single cable of transmission lines to the input of the receiver.

18. An antenna system as defined in claim 1, wherein the single cable includes thin coaxial cables.

19. An antenna system as defined in claim 1, wherein the cable includes thin twin wire cables.

20. An antenna system as defined in claim 1, wherein the transmission lines of said single cable are formed by a multiconductor flat cable having pseudo-inner conductors and pseudo-grounding conductors.

21. An antenna system as defined in claim 1, wherein said at least one high-frequency output line comprises at least one pseudo-grounding conductor arranged between pseudo-inner conductors.

22. An antenna system as defined in claim 1, wherein said ground point on the metal body is formed by a screw connection establishing galvanic electrical connection to the metal body.

23. An antenna system as defined in claim 1, further comprising a ferrite sleeve slidably inserted on the single cable of transmission lines to establish a low impedance coupling with the ground point for high-frequencies, the distance between the ground point and the ferrite sleeve being about a quarter of a mean wavelength of the high-frequencies and a portion of the single cable portion between the ground point and the ferrite sleeve being laid with a small spacing above the metal body.

* * * * *